US005927604A

United States Patent [19]

Laidler

[11] Patent Number: 5,927,604

[45] **Date of Patent: *Jul. 27, 1999**

[54] SPRAYING APPARATUS NOZZLE

[75] Inventor: Kevin O. Laidler, West Midlands, United Kingdom

[73] Assignee: Incro Limited, United Kingdom

[ * ] Notice: This patent is subject to a terminal disclaimer.

[21] Appl. No.: 08/941,260

[22] Filed: Oct. 1, 1997

Related U.S. Application Data

[63] Continuation of application No. PCT/GB96/00441, Feb. 28, 1996.

[30] Foreign Application Priority Data

Apr. 6, 1995 [GB] United Kingdom ..... 9507185

[51] Int. Cl.[6] ..... B05B 15/02

[52] U.S. Cl. ..... 239/104; 239/106; 239/115; 239/123; 239/451; 239/455; 239/600; 239/333; 239/337

[58] Field of Search ..... 239/104, 106, 239/114, 115, 123, 451, 452, 453, 455, 600, 602, 333, 337

[56] References Cited

U.S. PATENT DOCUMENTS

| | | | |
|---|---|---|---|
| 1,602,845 | 10/1926 | Burhorn | 239/452 |
| 3,178,120 | 4/1965 | Kappel | 239/600 |
| 3,250,474 | 5/1966 | McKernan | 239/123 X |
| 3,961,756 | 6/1976 | Martini | 239/337 |
| 4,013,231 | 3/1977 | Van Veldhoven | 239/600 X |
| 4,249,681 | 2/1981 | French | 239/452 X |
| 4,253,609 | 3/1981 | Laauwe | 239/600 X |
| 4,917,303 | 4/1990 | Maas et al. | 239/333 |
| 5,105,988 | 4/1992 | Knickerbocker | 239/115 X |
| 5,207,785 | 5/1993 | Knickerbocker | 239/115 X |
| 5,316,470 | 5/1994 | Sigler | 239/600 X |
| 5,373,991 | 12/1994 | Nelson | 239/333 |
| 5,743,468 | 4/1998 | Laidler | 239/115 |

*Primary Examiner*—Andres Kashnikow
*Assistant Examiner*—Robin O. Evans
*Attorney, Agent, or Firm*—Neil F. Markva

[57] ABSTRACT

A hollow body having a nozzle opening (19) to discharge fluid as a jet or spray; the body comprising a first part having an inlet **(12*a*) to admit fluid under pressure into the first part, and a second part (16) movable relative to the first part and said first and second parts are relatively movable from an abutting position in which they define therebetween the nozzle opening and a fluid feed passage (18)** in the body and leading to the nozzle opening, and a cleaning position in which the fluid feed passage is split open longitudinally and the nozzle opening is split open to expose the nozzle and passage defining surfaces of said parts, for cleaning.

10 Claims, 5 Drawing Sheets

FIG. 1
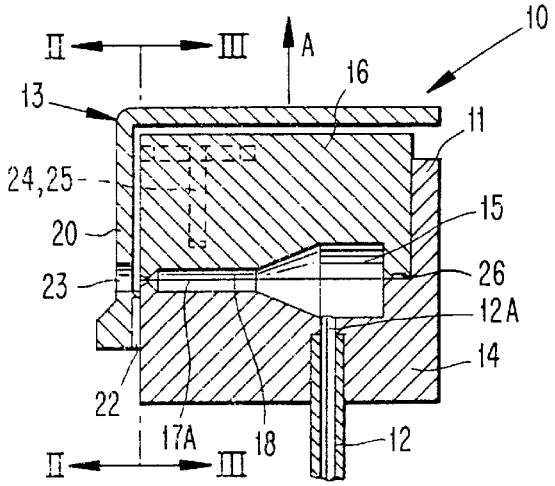
FIG. 2
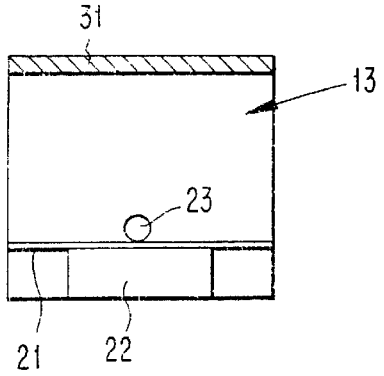
FIG. 3
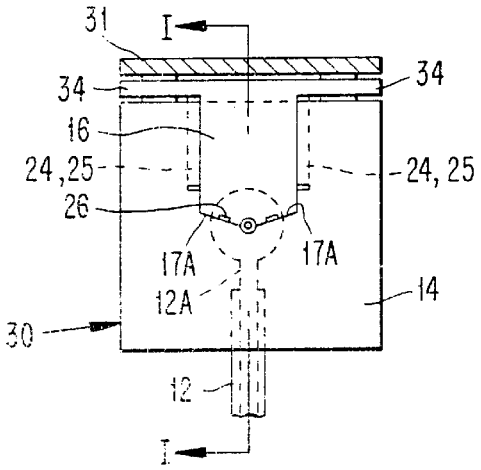
FIG. 4
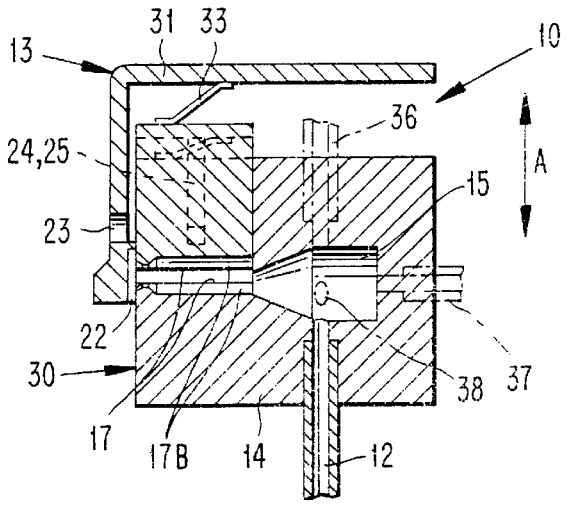
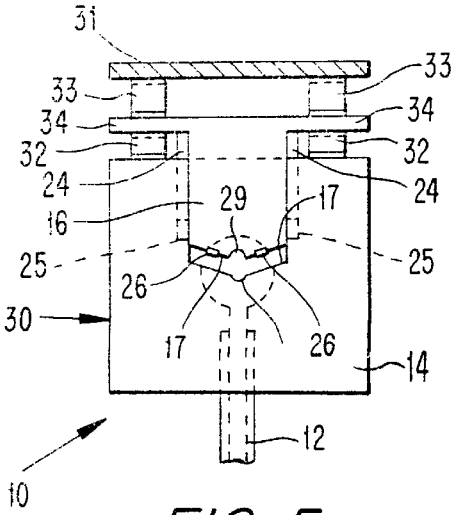
FIG. 5
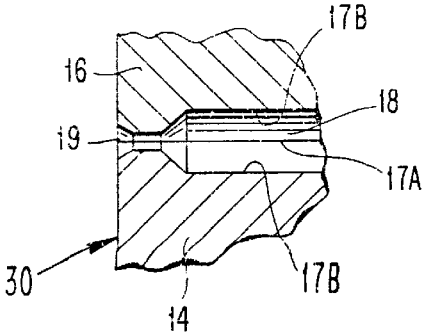
FIG. 6

SPRAYING APPARATUS NOZZLE

This is a continuation of the International patent application PCT/GB96/00441, filed Feb. 28, 1996 designating the United States of America, which is based upon GB 9507185.8, filed Apr. 6, 1995.

FIELD OF INVENTION

This invention concerns improvements in or relating to nozzle devices used in spraying apparatus, of a kind in which the nozzle device comprises a hollow body having a nozzle opening to discharge fluid as a jet or spray; the body comprising a first part having an inlet to admit fluid under pressure into the first part, and a second part movable relative to the first part; wherein the nozzle opening and a feed passage leading to the nozzle opening meet at a junction and are defined between portions of abutment surfaces of the first and second parts; and wherein the parts are at least partially separable to expose the feed passage and the nozzle opening and the junction for wiping.

BACKGROUND OF THE INVENTION

DE.U.9402633 discloses a nozzle device of said kind, in the form of a machined assembly which uses two threaded fasteners to clamp a planar abutment surface of a cover plate part onto an abutment surface of a nozzle body part so as to cover one side of a hollow formation providing a nozzle, a feed passage and an inlet duct recess, in the hollow body. For cleaning of the abutment surfaces, the assembly has to be disassembled, i.e. both fasteners need to be removed and the cover plate part lifted off the body in order to move its planar abutment surface directly away from the abutment surface on the body part. One of the fasteners extends through a cut-out in the cover part so that when the fasteners are partially released the cover part can be pivotally moved about the axis of the other fastener. However, even when the nozzle opening is exposed by such pivotal movement, portions of the abutment surfaces remain in abutment and cannot be wiped clean.

WO a 95 07 580 disclosed a two-part plastics injection moulding which is not of said kind and is primarily directed to the provision of a very smooth curved path or feed passage between an inlet and a nozzle outlet so as to reduce the tendency of materials to accumulate along the feed path in a moulded plastic nozzle device for an aerosol spray can. In most embodiments a two part body is used to hold in place a flexible tube which integrally includes the inlet, feed passage and nozzle opening, whereas in the embodiment shown in FIG. 14 the tube is omitted and the feed passage is defined between the two parts of the body, and these two parts are permanently connected together by an integral hinge, and together provide sockets for an inlet member and a separate nozzle member which respectively define the inlet and the nozzle opening. However, in no embodiment can the nozzle opening be wiped clean if it blocks so that the problem of nozzle blockage and effective sealing of the interface between said parts in the FIG. 14 embodiment remain.

From GB 2161401A there is known a cream dispenser having a nozzle device in which the second part is hollow and defines a passage leading from the nozzle opening at one end to another opening at the other end. Said other end is connected by a hinge to the first part so that the second part can be swung away from the first part to provide access to both said ends for rinsing out the passage in the second part. However, if the passage becomes blocked, rinsing is prevented and resort must be made to poking out the blocking material with an implement inserted via one or other of the openings.

Where finer nozzle openings are concerned for producing "atomized" sprays, the use of even a very fine implement to unblock the nozzle opening may not be practical or expedient, and may lead to damage to the -nozzle to the detriment of the spray pattern.

These problems are tacked by U.S. 3961756A which discloses a nozzle device in which the first part is formed to provide both the inlet and the nozzle opening, and the second part is in the form of a threaded valve plug which is rotatable in a threaded socket in the first part to move axially relative to the internal side of the nozzle opening to vary the spray pattern. The plug is removable to provide access to the inside side of the nozzle opening for removal of matter blocking the inside side of the opening.

However, the problems of blockage of the nozzle opening itself and the removal of residues sticking to the internal surfaces of the nozzle remain.

SUMMARY OF THE INVENTION

In order to overcome said problems, the present invention provides a nozzle device of said kind which is characterized in that the first part is attached to the second part by an integral flexible hinge which allows one of said parts to be swung away from the other to separate and expose said surfaces entirely while the parts remain connected by the hinge, and in that said parts have sealing means bordering said portions of said surfaces adjacent to said nozzle opening junction and feed passage; and in that said sealing means comprises a projecting formation on one of said surfaces which sealingly engages in a recessed formation or groove in the other surface, when said parts are swung to abut at an interface between said surfaces and held in abutment by retaining means.

The feed passage preferably meets the inlet at a junction which is exposed when the feed passage is split open.

The junction may be formed as a swirl chamber.

Either or both of said surfaces may define a concavity or concavities which constitute the nozzle opening and feed passage, and, optionally, said chamber or junction also.

Said surfaces preferably abut at an interface bordering said nozzle opening and feed passage.

Sealing means is preferably provided to interrupt or act between said surfaces adjacent to the nozzle opening and feed passage to limit egress of pressurized fluid between said abutting surfaces and to confine said pressurized fluid to flowing along said passage to the nozzle opening.

A cleaning member may be provided on or for the nozzle device in order to wipe said nozzle, scrape said nozzle, or obscure said nozzle, or to provide any combination of these functions.

In a preferred embodiment the two parts remain so that said surfaces abut at an interface at all times so that the opening and passage are normally formed. In this embodiment one of said parts has to be physically separated from the other part by the operator, when cleaning is required. Releasable retaining means may be provided to hold said parts together.

A manually actuable part is preferably provided to control said relative movement of the parts to occasion the flow of pressurized fluid, either directly or indirectly.

At least one of said body parts is preferably formed from a rigid material or formed so as to be rigid, so that it does not flex or distort in use.

Such problems are particularly prevalent in hand operated spraying apparatus employing small bore nozzles such as are found in aerosol cans, trigger operated spray containers and paint guns; and the invention takes advantage of a mechanical action to effect clearing of the opening or orifice by deformation and reformation, and/or by scraping or wiping of the surface around the opening or orifice each time the manually actuable part is moved by the operator. For example, in an aerosol can or similar apparatus, the manually actuable part may be the surface of the body which is usually depressed (against a bias provided by the fluid pressure, to occasion a flow of the pressurized fluid) so that the body and nozzle are moved relative to the cleaning member.

In a trigger pumped hand spray or similar apparatus, the trigger may serve as the manually actuable part and be arranged so that an initial movement thereof is transmitted to the cleaning member leaving the remaining movement (of the full trigger stroke) to be employed for pumping.

Within the nozzle device, the first and second parts of the body may be confined to linear or pivotal relative movement.

The chamber and/or the passage may incorporate or contain flow directing elements which may be attached to or formed on or in said body parts or body so as to be separable for cleaning.

The interface between the body parts is preferably transverse to the direction of movement.

The cleaning member or separate cleaning member preferably moves in the plane in which the opening or orifice opens and comprises a scraper or wiper, a cover part or seal to seal or cover the opening or orifice and obscure the exterior surfaces of the nozzle around said opening or orifice, and an outlet opening which registers with said opening or orifice for spray to pass through said member.

The invention includes spraying apparatus incorporating, fitted with or constructed and arranged to be fitted with and operate in conjunction with said nozzle device.

The invention will be described further, by way of example, with reference to the accompanying diagrammatic drawings, in which FIGS. 1 to 7 show various forms of proposals by the Inventor for separable two-part nozzle devices, which proposals are no longer within the scope of the invention as claimed, but the proposals include details and features which are applicable to the embodiments of the present invention shown in FIGS. 8 to 15 of the drawings.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

FIG. 1 shows a section through a proposed first form of nozzle device on a line I—I indicated in FIG. 3;

FIG. 2 shows a section through the device on the line II—II in FIG. 1;

FIG. 3 shows a section through the device on the line III—III in FIG. 1;

FIG. 4 is a sectional view similar to FIG. 1 showing a slightly modified form of the device in an inoperative condition;

FIG. 5 is a sectional view similar to FIG. 3 showing the device in the inoperative condition;

FIG. 6 is an enlarged detail of the nozzle of the device shown in FIG. 1;

DETAILED DESCRIPTION

Figure 7:
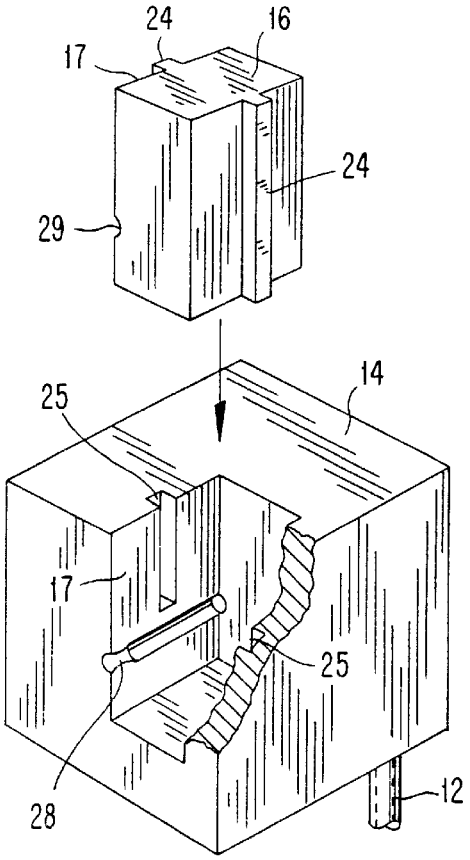
FIG. 7 is an exploded perspective diagram showing two body parts of a modified form separated from one another.

Referring to FIGS. 1 to 6, the proposed nozzle device 10 comprises a body 11, a feed pipe 12 to an inlet 12A and a cleaning member 13. The body 11 includes a first part 14 which defines part of a junction or chamber 15 into which the inlet 12A opens, and a separable second part 16. The two parts 14 and 16, in an operative condition of the device, abut at an interface 17A between parts of surfaces 17 bordering shaped concave portions 17B of said surfaces which define therebetween the chamber 15, a feed passage 18 (FIG. 6) leading from the chamber 15 to an opening or orifice 19 (FIG. 6) at the nozzle end 30 of the device, as shown in FIGS. 1 and 3. In the slightly modified form shown in FIG. 4, the second part 16 is shortened so that the portions 17B end before the chamber 15 which is formed in the part 14.

The part 16 is a sliding fit in a recess in the first part 14 and is restricted to movement in a direction A perpendicular to the axis of the passage 18 and orifice 19, so that the surfaces 17 can be separated to split apart (i.e. open up) the passage, the opening or orifice 19 and in the FIG. 1 form also the chamber 15.

The cleaning member 13 comprises an upper portion 31 and a shutter 20 which depends from the portion 31; is movable in said perpendicular direction A; and, as shown in FIG. 2 is provided with a wiper or scraper 21 between a seal 22 and an opening 23. In the operative condition (FIGS. 1 and 3) of the device the opening registers with the orifice 19, whereas in the inoperative condition (FIGS. 4 and 5) the seal 22 obscures and closes the nozzle end of the space between the surfaces 17.

The member 13 and part 16 are biased to the inoperative condition by suitable bias means such a flexible tongues 32,33 (FIG. 5) provided on flanges 34 on the part 16, and in use, the feed pipe 12 is inserted in known manner into an aerosol can of known form so that no spray is emitted.

In order to prevent forwards movement of the part 16, the parts 14,16 may be provided with flanges or keys 24 and keyways 25 indicated in broken lines in FIGS. 3 and 5. Sealing means, comprising compressible sealing ridges 26, may be provided on the surface 17 of the part 16 alongside the passage, or passage and chamber, to provide a pressure-tight seal during spraying.

To generate a spray discharge from the can, the operator depresses the upper portion 31 which shifts the shutter 20 downwards relative to the part 16 to cause the wiper/scraper 21 to traverse and clean the nozzle end 30 around the nozzle end of said space, and brings the opening 23 down to align with said space; said downwards movement is transmitted to the part 16 to drive the surfaces 17 into mutual abutment whereby to form or reform the orifice and passage; and said downwards movement is further transmitted to the part 14 and pipe 12 to open the known discharge valve in the can to permit the release of pressurized fluid from the can via the pipe 12, chamber 15, passage 18, orifice 19 and opening 23.

When the operator removes pressure from the upper surface of the portion 31 said movement is reversed under the biases provided by the pressure in the can and the bias means to restore the device to the inoperative condition, and during which restorative movement the wiper/scraper again cleans said nozzle end 30.

The feed pipe 12 may enter the body 11 from any suitable direction, e.g. from above, at the rear of the chamber or to lie tangential to the chamber as indicated by the ports 36, 37 and 38 shown in broken lines in FIG. 4.

The parts 14 and 16 may be modified further so that the interface surfaces 17 slide in mutual abutment instead of separating, e.g. as indicated in FIG. 7 so that the orifice and passage are deformed by being split without being opened up in the inoperative condition.

In all versions of the aforementioned proposed nozzle device, the second part is arranged to be separable from the first part to expose the concavities for wiping.

Instead of the device being arranged for linear relative movement of said body, parts, the device may be arranged so that said parts are pivotally movable.

For example in the proposed form shown in FIG. 1, the part 16 may be extended completely across the top of the part 14 to terminate at the rear at which it is connected to the part 14 by a hinge, and the tongues and grooves 24,25 are omitted because their function can be assumed by the hinge, then the part 16 will be able to be swung upwards to separate the surfaces for cleaning of the passage and the chamber. In such a modification the member 13 would preferably be pivotally connected to an upper part of the part 16.

Figure 8:
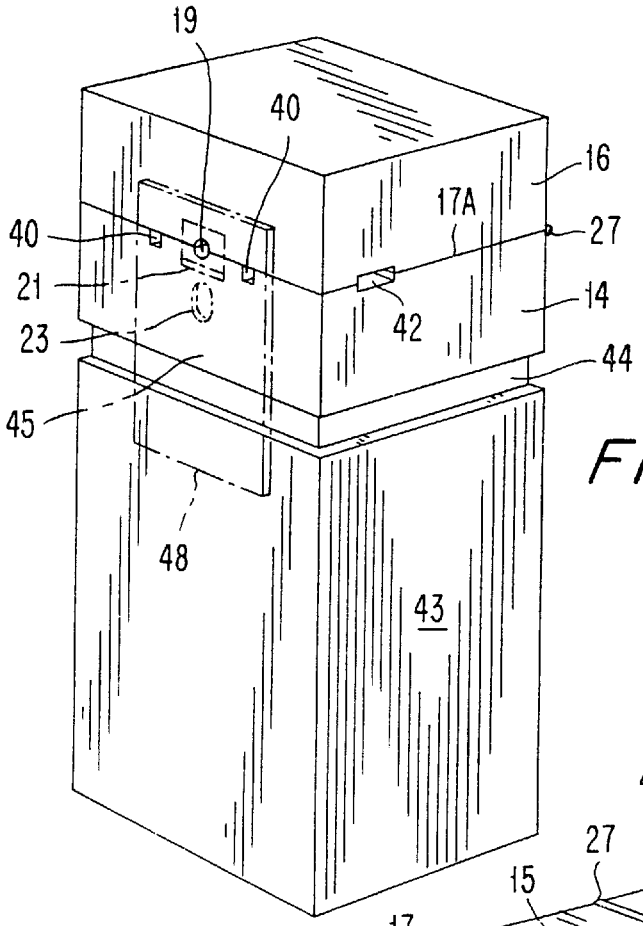
FIG. 8 shows a first embodiment of the invention in the operative condition.
Figure 9:
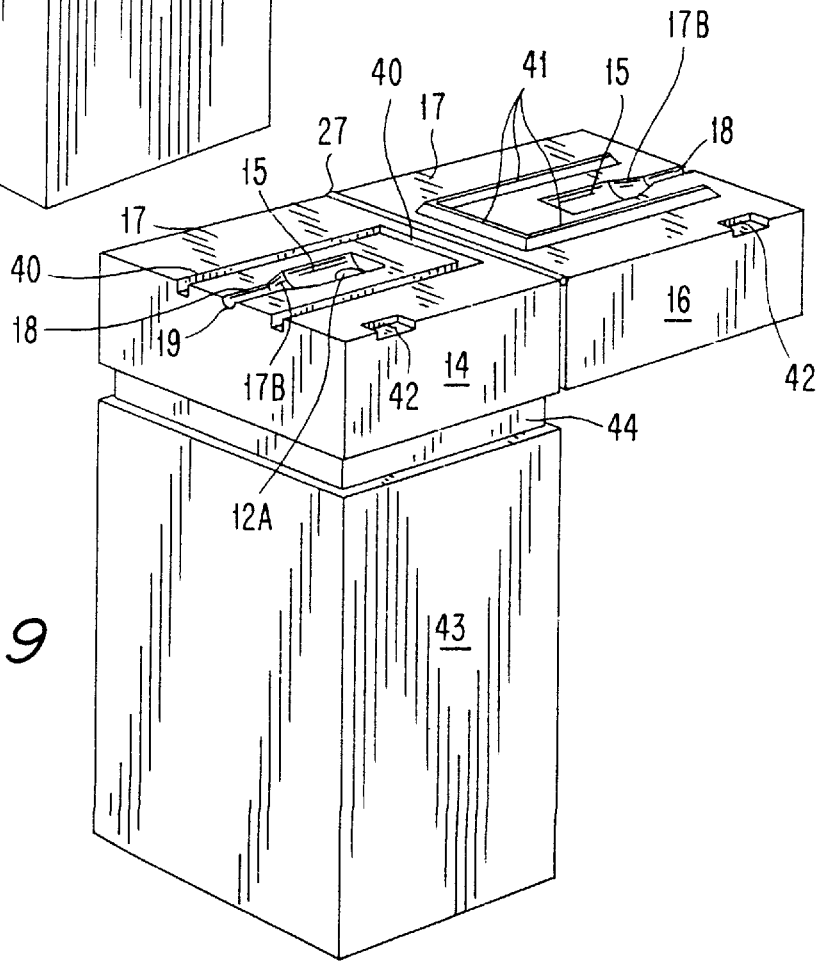
FIG. 9 shows the first embodiment in an inoperative condition, ready for cleaning.

In the first embodiment of the present invention shown in FIGS. 8 and 9, the part 14 of the body forms a base and the part 16 of the body forms a lid pivotally attached to the base at the end remote from the nozzle 18 by a hinge 27. The two parts each provide one surface 17 in which surfaces concavities are formed to provide the parts 17B, as shown in FIG. 9. Alongside the cavities recesses 40 are formed in the base part 14 and sealing ribs 41 are formed on the upper lid part 16 to sealingly engage in the recesses so as serve as sealing means bordering the nozzle orifice and passage to prevent egress of fluid across the interface 17A. The ribs are preferably a snap-fit in the recesses so as to retain and urge the two parts 14,16 together so that under normal conditions the junction chamber 15, passage 18 and orifice 19 remain formed, i.e. the device normally assumes and maintains the operative condition. When cleaning is required the two parts 14 and 16 may be prised apart e.g. by insertion of a screwdriver blade in a pair of recesses 42 so that the upper part can be swung to the condition shown in FIG. 9 to expose said surfaces and concavities therein including the portions of the concavities defining the chamber 15. The feed pipe 12 connected to the inlet 12A is not shown as it is concealed by the part 14 and the spray can 43 which forms part of the apparatus, the upper end 44 of the spray can being recessed so that the part 14 can be depressed to actuate the valve within the spray can 43 so that fluid can be supplied to the feed pipe 12 to the inlet 12A. In this embodiment, as shown in broken lines in FIG. 8 the cleaning member 13 can comprise a tongue 45 upstanding from the spray can 43, with the positions of the seal 22, scraper 21 and aperture 23 inverted so that in the normal condition the nozzle orifice 19 is covered by the seal 22 until such time as the device is depressed against the pressure in the can so as to open the valve and bring the nozzle orifice into alignment with the aperture, and during that movement the nozzle orifice will traverse the scraper or wiper 21 and be cleaned thereby.

Figure 10:
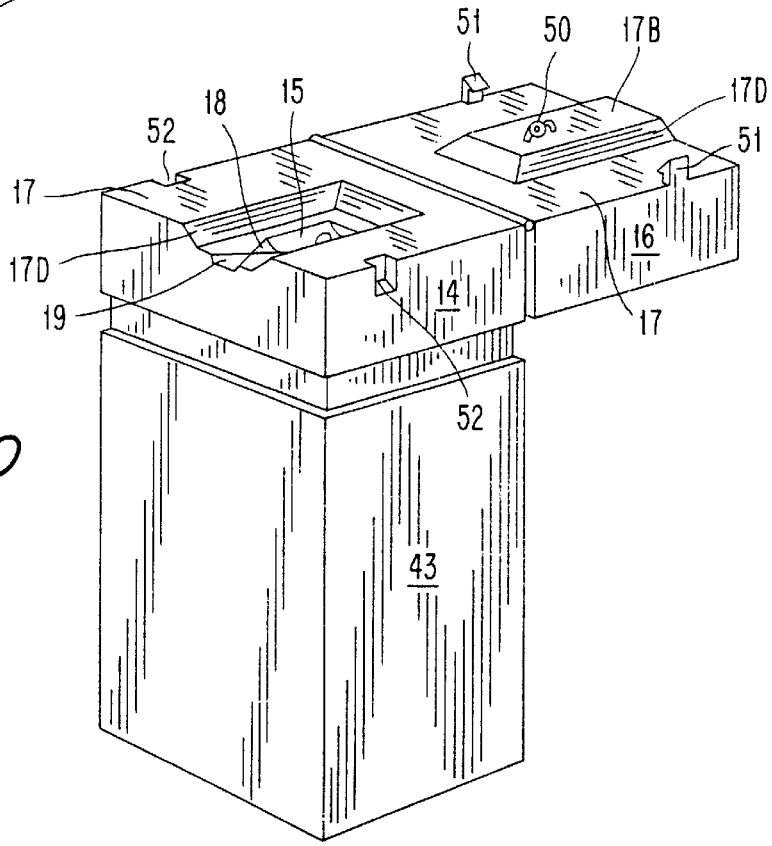
FIG. 10 shows a modified version of the first embodiment in the same condition.

A modified form of the first embodiment is shown in FIG. 10. This modified form illustrates several modifications applicable to all embodiments of the invention, namely:

1. That the nozzle opening 19, passage 18 and junction chamber 15 can all be provided by a concavity in one of said parts, e.g. the bottom part 14, and that the defining portion 17B of the other part, e.g. the upper part 16, may be substantially planar.
2. That the abutment surfaces 17 may be stepped to include sealing portions 17D which serve as sealing means bordering the portions 17B.
3. That the chamber 15 may include a swirl producing insert 50, which insert may be free or attached to either of the parts 14, 16.
4. That releasable retaining means may be provided, such as flexible barbed catches 51 to engage in stepped open sockets 52, to retain the two parts 14 and 16 with the surfaces 17 abutting, i.e. to retain said parts in the operative condition. The catches 51 may be released manually to allow the second part to spring upwards about the hinge.

In the above embodiment the nozzle device and/or spray can have been shown, diagrammatically as being based on a rectangular shape whereas, in reality, the basic shape of the nozzle and the spray can will be circular in most instances, as exemplified in the second embodiment shown in FIGS. 11 to 14.

Figure 11:
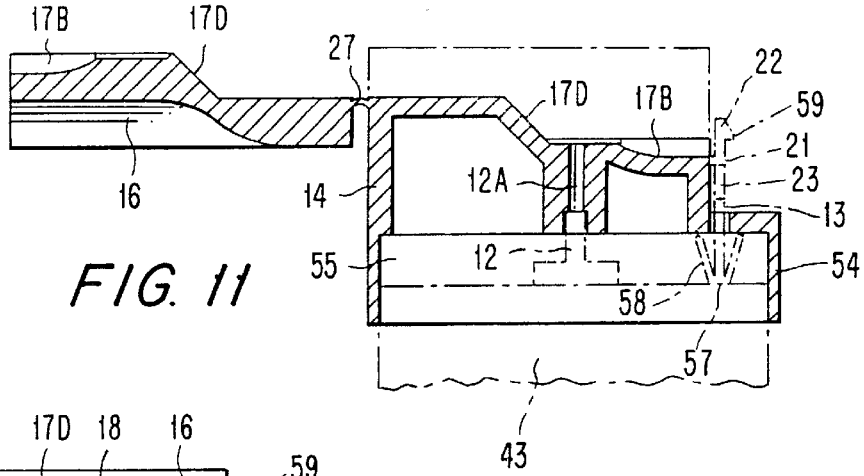
FIGS. 11 and 12 are sectional views of a second embodiment of the invention, in an opened for cleaning condition and a closed for spraying condition respectively.
Figure 12:
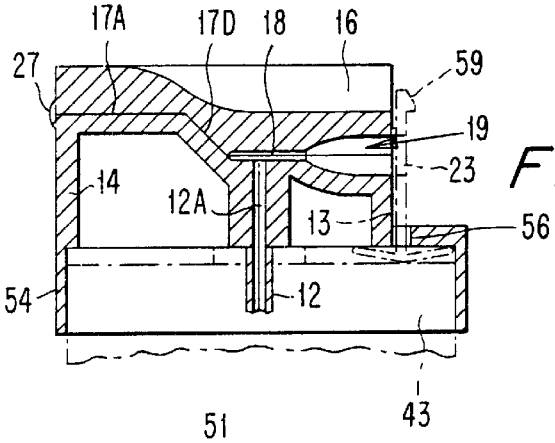
Figure 13:
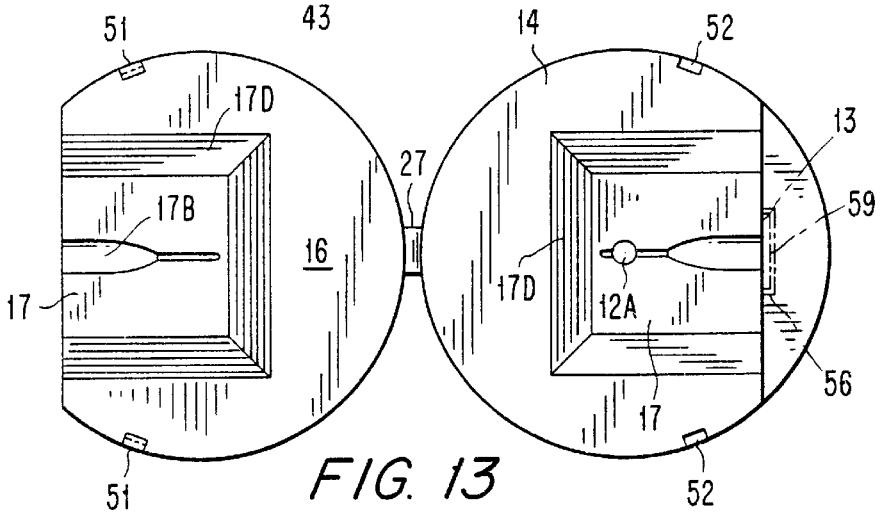
FIG. 13 is a plan view of the second embodiment in the open condition.
Figure 14:
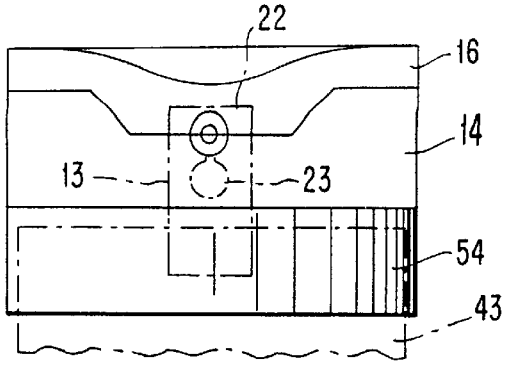
FIG. 14 is a front elevation of the second embodiment in the closed condition.

FIGS. 11 to 14 show a second embodiment of the nozzle device in a less diagrammatic form shaped to fit on a standard circular-section aerosol can 43 partially indicated in FIG. 11. In this embodiment the lower part 14 has a skirt 54 around a socket 55 to receive the can 43 in known manner so that the feed pipe 12, which may be part of the valve device 53 of the can (FIG. 11) or part of the lower part 14 (FIG. 12), opens into the inlet 12A. The inlet 12A opens directly into a chamberless junction with the passage 18 which terminates at the nozzle opening 19 which is of outwardly divergent form. The surfaces 17 are stepped to provide the sealing means 17D. The hinge 27 is short, and as shown in FIG. 13, the parts 14 and 16 are provided with the releasable retaining means 51,52.

In this embodiment, the optional cleaning member 13 passes through a slot 56 in the lower part 14, and has a base 57 which is urged into abutment with the can 43 by spring fingers 58 on the base, which fingers are compressed when the device is depressed (to open the valve) so that the opening 23 moves to register with the opening 19 as indicated in FIG. 12. A lug 59 prevents the member 13 falling back through the slot 56 when the device is removed from the can.

Figure 15:
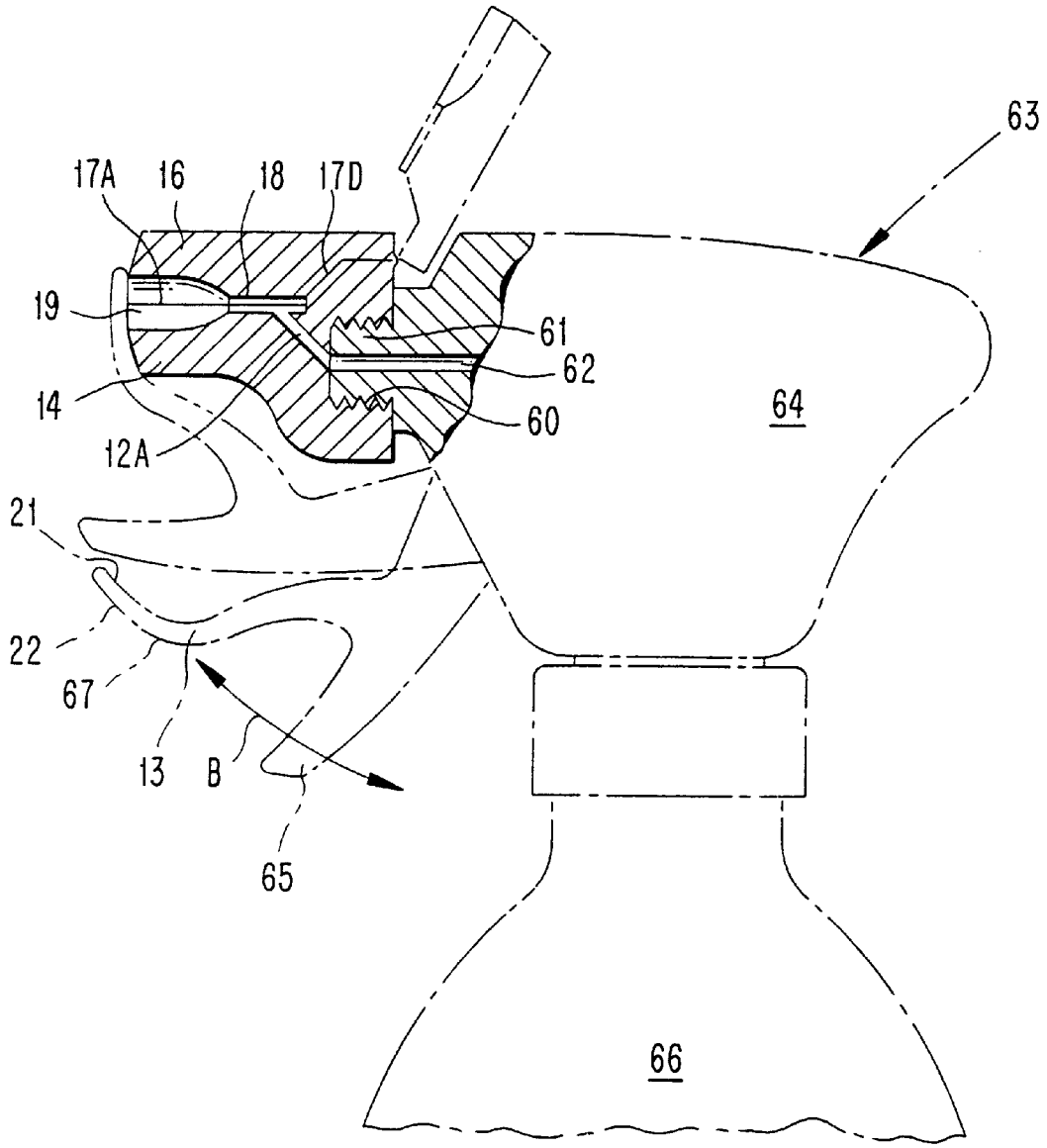
FIG. 15 is a part sectional view of a third embodiment in the closed condition in situ in spraying apparatus shown partially in broken outline.

FIG. 15 shows spraying apparatus comprising a hand held gun of known form fitted with a third embodiment of the nozzle device. The first, lower, part 14 of the device provides a threaded socket 60 which is screwed onto an outlet spigot 61 of the body 64 of the gun 63 of the spraying apparatus so that the inlet 12A, which is inclined in this embodiment, communicates with the pressurized fluid outlet duct 62 of the apparatus. The upper part 16 and lower part 14 are otherwise internally constructed and hinged together as previously described, and are externally shaped to compliment the style of the apparatus 63.

If a cleaning member is required, an extension 64 can be provided on the trigger 65 and provided with the wiper 21 and seal 22 so that it covers the front of the nozzle device when the trigger is in a fully raised position as outlined in FIG. 15 and wipes the external surface around the nozzle opening 19 when the trigger is lowered to an inuse position (also outlined) for movement through a pumping arc indicated by arrow B to pump fluid from the reservoir 66 to the duct 62.

The invention is not confined to details of the foregoing examples and many variations are possible within the scope of the invention.

For example, any feature of form or function disclosed in any one embodiment may be employed or substituted in any other embodiment. Other modifications and functional equivalents may be employed, e.g. in the third embodiment the lower part 14 may be integral with the body 64. In the first, second and third embodiments the part 16 may be a snap-fit on the part 14.

The invention further includes and provides a nozzle device or spraying apparatus as claimed in claim 1 and further incorporating any novel part or feature, or any combination of parts and features disclosed herein and/or in the accompanying drawings; and further includes mechanical and functional equivalents thereof. The terms used herein are by way of illustration and merely examples of terms which fall within generic terms and are to be understood as including synonyms and generic terms.

I claim:

1. A nozzle device comprising:

a) a hollow body having a nozzle opening to discharge fluid as a jet or spray;

b) the body comprising a first part having an inlet to adnit fluid under pressure into the first part, and a second part movable relative to the first part;

c) wherein the nozzle opening and a feed passage leading to the nozzle opening meet at a junction and are defined between portions of abutment surfaces of the first and second parts; and d) wherein the parts are at least partially separable to expose the feed passage and the nozzle opening and the junction for wiping;

e) an integral flexible hinge attaches first part to second part to allow one of said parts to be swung away from the other to separate and expose said surfaces entirely while the parts remain connected by the hinge, f) said parts (14,16) have sealing means bordering said portions of said surfaces adjacent to said nozzle opening junction and feed passage; and g) said sealing means comprises a projecting formation on one of said surfaces which sealingly engages in a recessed formation or groove in the other surface, when said parts are swung to abut at an interface between said surfaces and are held in abutment by retaining means.

2. A nozzle device as claimed in claim 1 wherein the first part (14) is a base attachable to a fluid container vessel (43) having valve means openable by movement of the base to supply a flow of the fluid under pressure to the inlet (12A), and the second part is a lid (16) which can be swung into snap-fit engagement with the base.

3. A nozzle device as claimed in claim 2 wherein the retaining means (40,41:51,52) allows the lid (16) to be pried open.

4. A nozzle device as claimed in claim 1 wherein the surfaces (17) are stepped to provide inclined surface portions (17D) which serve as said sealing means.

5. A nozzle device as claimed in claim 1 wherein each of said surfaces (17) has a concavity (17B) therein which defines part of each of the nozzle opening (19), the feed passage (18) and the junction (15).

6. A nozzle device as claimed in claim 5 wherein the junction is formed as a swirl chamber (15).

7. Spraying apparatus comprising a nozzle device as claimed in claim 2, a vessel (43) containing fluid under pressure, valve means actuable by depression of a pipe (12) in the valve means to release said fluid into said pipe, wherein the device (10) and pipe (12) are arranged so that manual application of pressure to a top surface of the lid is transmitted via the interface to the base to move the body towards said vessel for actuating said valve means.

8. Spraying apparatus comprising a nozzle device as claimed in claim 1 attached to an outlet (61,62) of a body (64) of the apparatus, a vessel (66) to contain fluid to be sprayed releasably attached to said body (64), and a trigger (65) actuable for pumping fluid from said vessel to said outlet (62).

9. Spraying apparatus as claimed in claim 8 wherein a cleaning member (21) is provided on the trigger to obscure and wipe said nozzle opening (19).

10. Apparatus as claimed in claim 7 wherein a cleaning member (13:45) is provided for the nozzle device (10) in order to obscure said nozzle opening (19) and to wipe said nozzle opening (19) when the body is depressed to open the valve means.

* * * * *